US007942214B2

(12) United States Patent
Johnson et al.

(10) Patent No.: US 7,942,214 B2
(45) Date of Patent: May 17, 2011

(54) STEERABLE DRILLING SYSTEM

(75) Inventors: Ashley Johnson, Cambridge (GB); John Cook, Cambridge (GB); Paul Wand, Cambs (GB); Steven Hart, Yate (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/600,575

(22) Filed: Nov. 16, 2006

(65) Prior Publication Data

US 2008/0115974 A1 May 22, 2008

(51) Int. Cl.
*E21B 7/06* (2006.01)

(52) U.S. Cl. ..... 175/61; 175/73; 175/76

(58) Field of Classification Search ..... 175/61, 175/73, 76

See application file for complete search history.

(56) References Cited

U.S. PATENT DOCUMENTS

| | | | | |
|---|---|---|---|---|
| 4,076,084 | A | 2/1978 | Tighe | |
| 4,319,649 | A | 3/1982 | Jeter | |
| 4,768,719 | A | 9/1988 | Straubel et al. | |
| 5,341,886 | A | 8/1994 | Patton | |
| 5,979,570 | A | 11/1999 | Chance et al. | |
| 6,290,003 | B1 | 9/2001 | Russell | |
| 6,732,817 | B2 * | 5/2004 | Dewey et al. | 175/57 |
| 6,920,944 | B2 * | 7/2005 | Eppink et al. | 175/53 |
| 7,216,726 | B2 | 5/2007 | Swietlik et al. | |
| 2004/0200613 | A1 * | 10/2004 | Fripp et al. | 166/250.01 |

FOREIGN PATENT DOCUMENTS

| | | |
|---|---|---|
| DE | 019531319 | 2/1997 |
| FR | 002590328 | 5/1987 |
| GB | 1288284 | 9/1972 |
| GB | 2423102 | 8/2006 |

* cited by examiner

*Primary Examiner* — Giovanna C Wright

(74) *Attorney, Agent, or Firm* — Vincent Loccisano; Jeremy Welch; Brigitte Echols

(57) ABSTRACT

A steerable drilling system comprises a rotary drill bit 14 secured to a housing 16, a secondary rotary drill component 22 carried by the housing and rotatable therewith, the second rotary drill component 22 having a gauge dimension greater than that of the rotary drill bit 14, and a drive arrangement operable to displace the secondary rotary drill component 22 relative to the housing 16 while maintaining an axis 24 of the secondary rotary drill component 22 substantially parallel to an axis 18 of the housing 16.

13 Claims, 5 Drawing Sheets

STEERABLE DRILLING SYSTEM

This invention relates to a steerable drilling system, and in particular to a system adapted for drilling a borehole in a subterranean formation, for example for subsequent use in the extraction of oil and/or natural gases.

BACKGROUND OF THE INVENTION

Steerable drilling systems are well known and take a range of forms. In one arrangement, a rotatable drill bit is mounted upon a housing at an angle to the axis of the adjacent part of the borehole. By controlling the angular position of the housing, and hence the orientation of the drill bit, specifically the axis of rotation thereof, the drilling direction can be controlled. Another form of steerable drilling system includes a drill bit secured to a bias unit, the bias unit having a plurality of bias pads associated therewith, each of which is movable between a retracted position and an extended position. Each bias pad, when in its extended position, bears against the wall of the borehole resulting in the application of a lateral reaction force to the bias unit, and hence to the drill bit. By appropriate control over the timing of the movement of the bias pads relative to rotation of the bias unit, the system can be controlled so as to urge the drill bit in a desired direction, hence enabling drilling of the borehole in a desired direction or along a desired path.

GB2423102 describes an arrangement in which a drill bit and a bias unit are formed integrally with one another, the bias unit having provided thereon a series of pivotable bias pads, each of which carries a series of cutting elements.

It is desirable to be able to provide a system which is of reduced axial length and in which relatively little power is consumed in the operation of the system.

SUMMARY OF THE INVENTION

According to the present invention there is provided a steerable drilling system comprising a rotary drill bit secured to a housing, a secondary rotary drill component carried by the housing and rotatable therewith, the second rotary drill component having a gauge dimension greater than that of the rotary drill bit, and a drive arrangement operable to displace the secondary rotary drill component relative to the housing whilst maintaining an axis of the secondary rotary drill component substantially parallel to an axis of the housing.

The system preferably further comprises a near bit stabiliser, the secondary rotary drill component being located between the near bit stabiliser and the rotary drill bit.

In use, if it is desired to form a dogleg or curve in the borehole, the system is operated with the secondary rotary drill component displaced in the desired direction, thus cutting the borehole so as to be eccentric to the axis, the reaction forces being borne primarily by the near bit stabiliser. During subsequent operations, the near bit stabiliser will be pushed into the part of the borehole formed whilst the secondary rotary drill component was displaced, resulting in the rotary drill bit being urged in the desired direction. As, in use, the housing and secondary rotary drill component rotate, it will be appreciated that in order for the secondary rotary drill component to be displaced, substantially continuously, in the desired direction, the position of the secondary rotary drill component relative to the housing will require substantially continuous adjustment.

Compared to many existing arrangements, it is thought that the arrangement of the invention will permit steering to be achieved with much lower loads being applied, and thus using less power.

The secondary rotary drill component is conveniently of generally annular form.

The drive arrangement operable to displace the secondary rotary drill component could comprise a plurality of linear actuators, for example in the form of pistons or other hydraulic actuators, or piezo transducer arrangements. Alternatively, an eccentric cam arrangement may be used to drive the secondary rotary drill component to displace it relative to the housing.

The rotary drill bit may take a range of forms. For example, it may comprise a bit body upon which a series of cutting elements are fixed, or into which a series of cutting elements are impregnated. Alternatively, it may comprise a roller-cone type drill bit or a tri-cone drill bit. It will be appreciated that other types of drill bit could also be used. Likewise, the secondary rotary drill component may include, for example, cutting elements of the fixed or roller-cone type.

The invention further relates to a method of forming a borehole comprising rotating a rotary drill bit about its axis to form a borehole, rotating a secondary rotary drill component of gauge dimension greater than the gauge dimension of the rotary drill bit about its axis, and displacing the axis of the secondary rotary drill component relative to the axis of the rotary drill bit to form a displaced region in the borehole.

The method preferably further comprises a step of providing a near bit stabiliser, and moving the near bit stabiliser into the displaced region of the borehole to apply a side load to the rotary drill bit.

BRIEF DESCRIPTION OF THE DRAWINGS

The invention will further be described, by way of example, with reference to the accompanying drawings, in which.

DETAILED DESCRIPTION OF THE PREFERRED EMBODIMENTS

Figure 1:
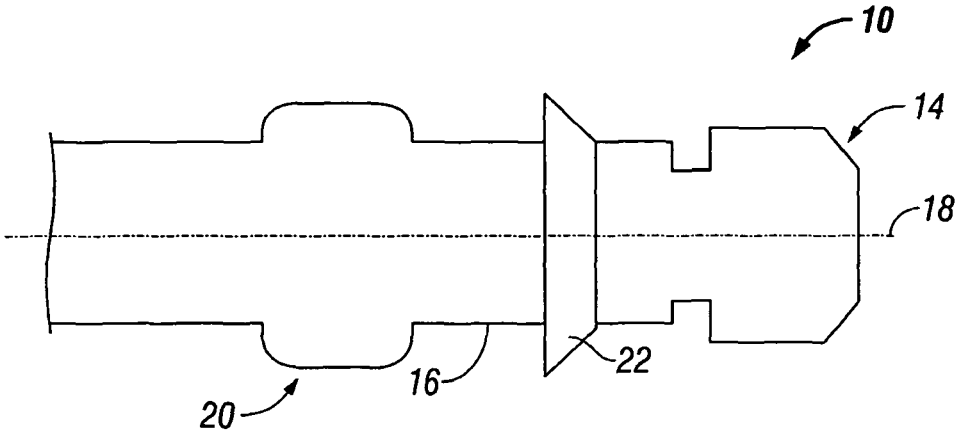
FIGS. 1 and 2 are diagrammatic views of a system in accordance with one embodiment of the invention in two different operating modes.
Figure 2:
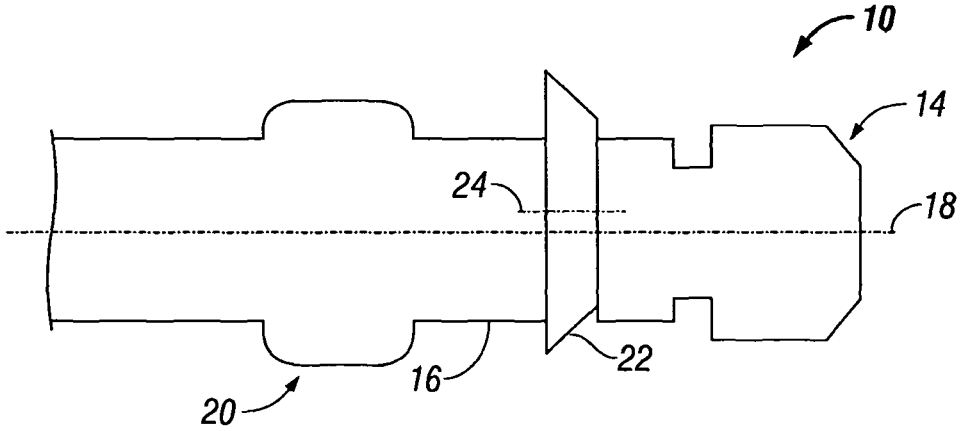
Figure 3:
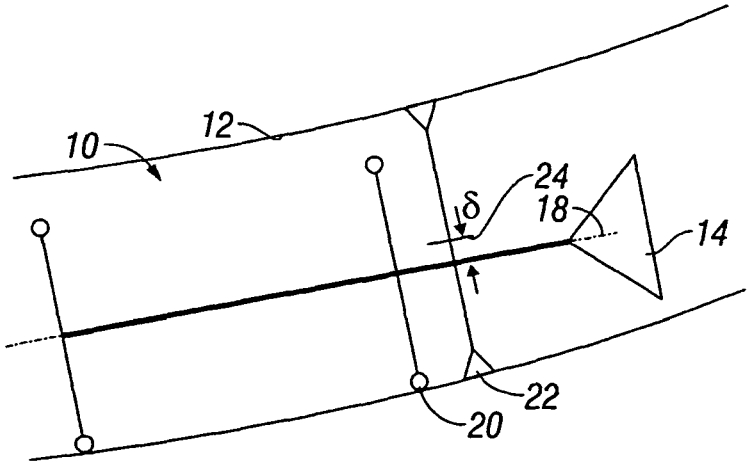
FIG. 3 is a diagram illustrating the system in use.

Referring firstly to FIGS. 1 to 3 there is illustrated a steerable drilling system 10 for use in the drilling of a borehole 12 in a subsurface formation. The drilling system 10 comprises a rotary drill bit 14 mounted upon a housing 16, the housing 16 and drill bit 14 being arranged to be rotated about their axis 18, for example by a downhole located motor or by a motor located at the surface. The housing 16 is secured to a near bit stabiliser 20. Another, upper stabiliser 21 is located at a position spaced from the near bit stabiliser 20.

The rotary drill bit 14 may take a range of forms. For example, it may of the fixed cutter type, the roller-cone type or be of the tri-cone type.

Encircling the housing 16 is a secondary rotary drill component 22. The secondary rotary drill component 22 is secured to the housing 16 so as to be rotatable therewith, but is capable of being displaced laterally relative to the housing 16 by a drive arrangement described below so as to shift or displace the axis 24 of the component 22 relative to the axis 18 so that the axes 18, 24 are substantially parallel to, but displaced from, one another.

The component 22 is of larger diameter than the drill bit 14 such that, in normal use, the drill bit 14 cuts a hole of diameter smaller than the desired gauge diameter, the component 22 serving to increase the diameter of the hole to the desired gauge.

In use, the drilling system is operated such that the housing 16 and bit 14 are rotated about the axis 18. As the secondary drill component 22 is secured to the housing 16, it will be appreciated that the component 22 will also rotate. When there is no requirement for the formation of a deviation or dogleg in the borehole 12, then the component 22 is held such that its axis 24 is substantially coaxial with the axis 18. This configuration is illustrated in FIG. 1. In this configuration it will be appreciated that rotation of the housing 16, bit 14 and component 22, in combination with the application of a weight-on-bit loading to the system, will cause cutters mounted upon the drill bit 14 and the component 22 to gouge, abrade, scrape or otherwise remove material from the formation in which the borehole 12 is being formed, thereby extending the borehole. The material cut from the formation in this manner is carried away from the drill bit 14 and component 22 using drilling fluid or mud supplied through the drill string to the drill bit 14 in the usual manner. The cutters provided on the secondary rotary drill component 22 may be of the fixed or roller-cutter type.

If it is desired to form a dogleg in the borehole 12, then the component 22 is moved relative to the housing 16 by the associated drive arrangement to hold the component 22 in a displaced position in which the axis 24 thereof is displaced relative to the axis 18 of the housing 16 and bit 14. The direction in which the component 22 is displaced is chosen to match the direction in which the dogleg is to be formed. Rotation of the housing 16, drill bit 14 and component 22 in combination with the application of a weight-on-bit loading to the system as described hereinbefore will, again, result in the removal of formation material thereby extending the borehole 12. It will be appreciated that in order to keep the component 22 held in the desired displaced position as the housing 16 rotates, the drive arrangement associated with the component 22 will need to continuously or substantially continuously move the component 22 relative to the housing 16. It will be appreciated that whilst the component 22 is held in a displaced position, it serves to form a displaced region in the borehole.

At a subsequent point in the operation of the system, the system will be moved to a position in which the near bit stabiliser 20 is located within the part of the borehole 12 formed by the secondary component 22 during the period of time when the component 22 was displaced relative to the housing 16, ie the displaced region of the borehole. It will be appreciated that such location of the near bit stabiliser 20 results in the application of a sideways acting load to the rotary drill bit 14, thus urging the drill bit 14 in the desired direction.

Figure 4:
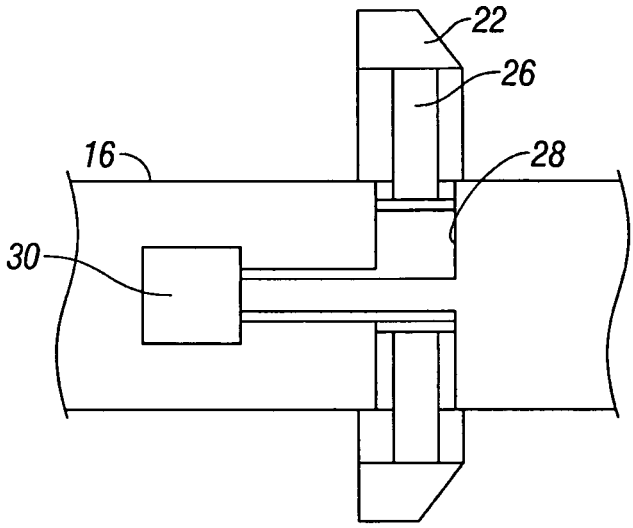
FIG. 4 is a view illustrating one form of drive arrangement.

The drive arrangement used to shift or displace the component 22 relative to the housing 16 may take a range of forms. For example, FIG. 4 illustrates, diagrammatically, an arrangement in which the housing 16 is provided with a series of pistons 26 reciprocable within respective cylinders 28, each piston 26 being movable between a retracted position and an extended position. A control valve 30 controls the supply of fluid under pressure to each cylinder 28, controlling the position occupied by each piston 26. It will be appreciated, therefore, that the position occupied by the secondary component 22 relative to the housing 16 can thus be controlled.

Although FIG. 4 illustrates the use of pistons as the drive arrangement operable to move the secondary component 22 to displace the axis 24 thereof relative to the axis 18 of the housing 16, it will be appreciated that other forms of linear actuator could be used. For example, piezo transducer arrangements could be used, if desired. Further, although FIG. 4 illustrates an arrangement in which the pistons 26 are arranged substantially radially and act directly upon the component 22, it will be appreciated that other orientations are possible and that the linear actuators could act on the component 22 through a cam or pivot arrangement, if desired. It is envisaged that the displacement of the component 22 will be small, for example of the order of 5 mm and that the maximum load on the component 22 will be of the order of 300 lbs. Displacement of the component 22 relative to the housing 16 is envisaged to use approximately 100 watts of power.

Figure 5A:
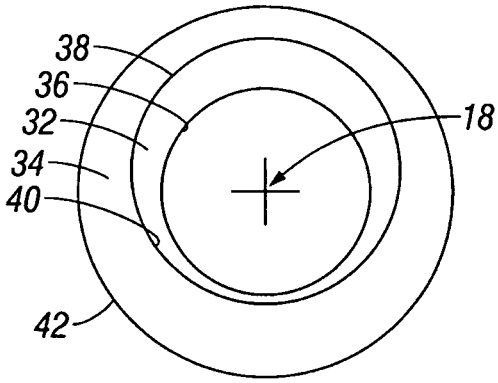
FIG. 5*a* and 5*b* illustrate an alternative drive arrangement.
Figure 5B:
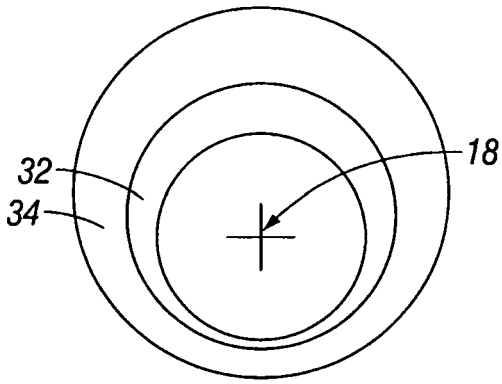

Rather than use linear actuators, for example of the type illustrated in FIG. 4, another possible drive arrangement for use in displacing the component 22 relative to the housing 16 involves the use of an eccentric cam arrangement. FIG. 5 illustrates such a cam arrangement. As illustrated in FIG. 5, the cam arrangement comprises a first, inner cam 32 and a second, outer cam 34. The inner cam defines an opening 36 which is eccentric to the outer surface 38 thereof. Similarly, the outer cam 34 defines an inner opening 40 which is eccentric to the outer surface 42 of the outer cam 34. The inner cam 32 is fitted into the opening 40 formed in the outer cam 34, the cams 32, 34 being arranged such that, in one orientation of the outer cam 34 relative to the inner cam, the opening 36 of the inner cam 32 is concentric with the outer surface 42 of the outer cam 34. This condition is illustrated in the left-hand side of FIG. 5. The right-hand part of FIG. 5 illustrates the opposite extreme situation where the outer cam 34 has been rotated relative to the inner cam 32 through an angle of 1800 resulting in the outer surface 42 of the outer cam 34 being eccentric to the opening 36 of the inner cam 32.

The housing 16 extends through the opening 36, and a first motor arrangement is provided to control the angular position of the inner cam 32 relative to the housing 16. The outer surface 42 of the outer cam 34 forms or is secured to the component 22. A second motor arrangement may be provided to control the relative angular position between the inner and outer cams 32, 34.

It will be appreciated that by appropriate control over the operation of the first and second motors, the component 22 can be arranged to be rotated, with the housing 16, with the component 22 arranged either such that its axis 24 lies coaxial with the axis 18 of the housing 16 or with the axis 24 displaced from the axis 18, the direction in which the axis 24 is displaced being selected by operation of the motors. In some applications, it is thought that the provision of two such motors, and the control arrangements associated therewith, may be too complex. In such arrangements, a single motor may be used, for example to control the angular position of the inner cam 32 relative to the housing 16, and a ratchet arrangement used to allow relative rotation between the inner and outer cams 32, 34 in one rotary direction, but to restrict such movement in the reverse direction. With such an arrangement, if the inner cam 32 is rotated in one direction, the ratchet arrangement allows the outer cam 34 to remain stationary, due to the frictional loadings thereon, thus the eccentricity of the system is adjusted. If the inner cam 32 is driven in the opposite direction, the ratchet arrangement causes the entire cam assembly to be rotated with the cam arrangement at the chosen eccentricity.

With the arrangements described hereinbefore, in use, the majority of the borehole 12 is cut by the rotation of the drill bit 14 in the usual manner. It is anticipated that at least 90% of the formation material will be removed by the drill bit 14. Consequently, the component 22 and drive means associated therewith bears relatively little of the weight-on-bit loading. It is envisaged that the component 22 will need to bear approximately 10% of the weight-on-bit loading, and approximately 15% of the applied torque.

Figure 6:
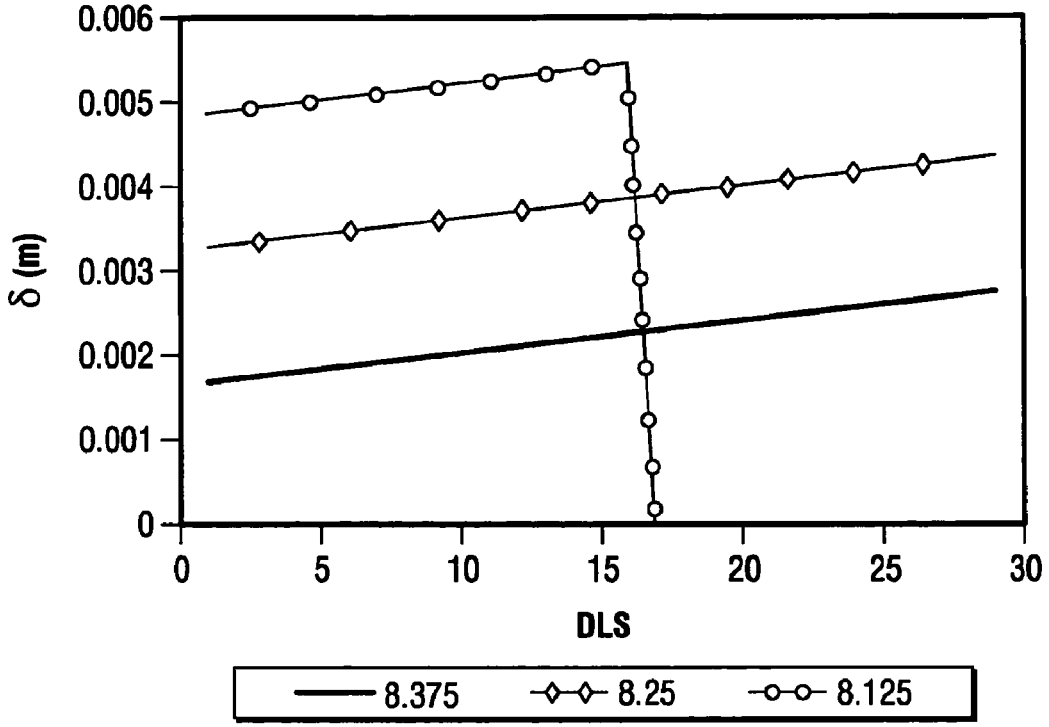
FIGS. 6 to 11 are graphs illustrating the effectiveness of the system under various operating conditions.
Figure 7:
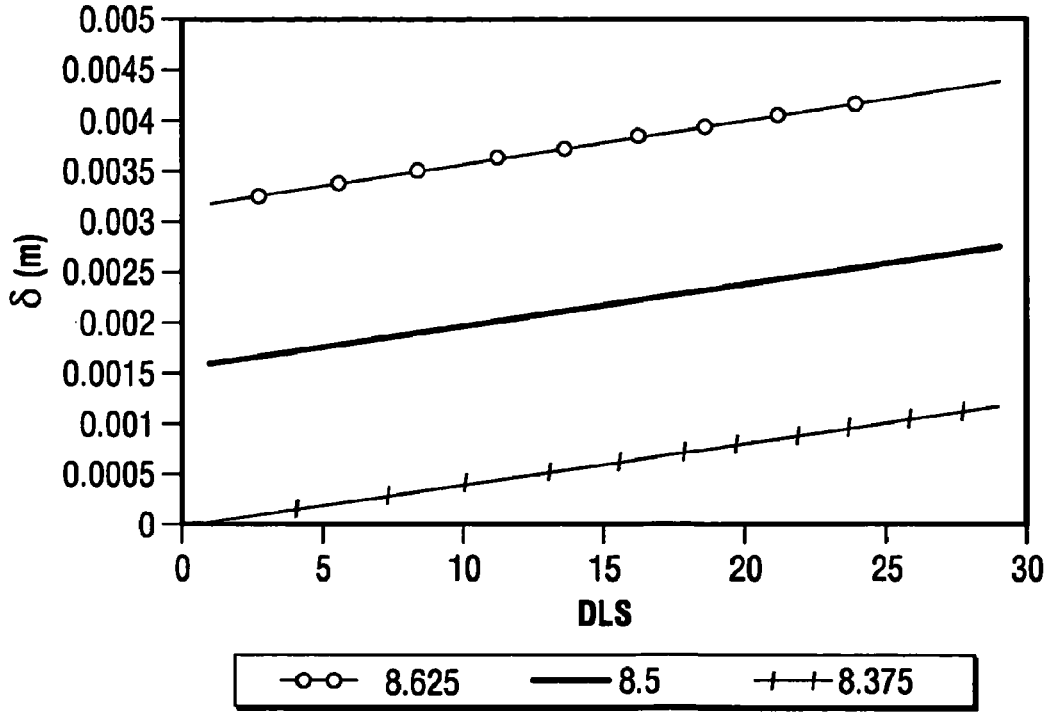
Figure 8:
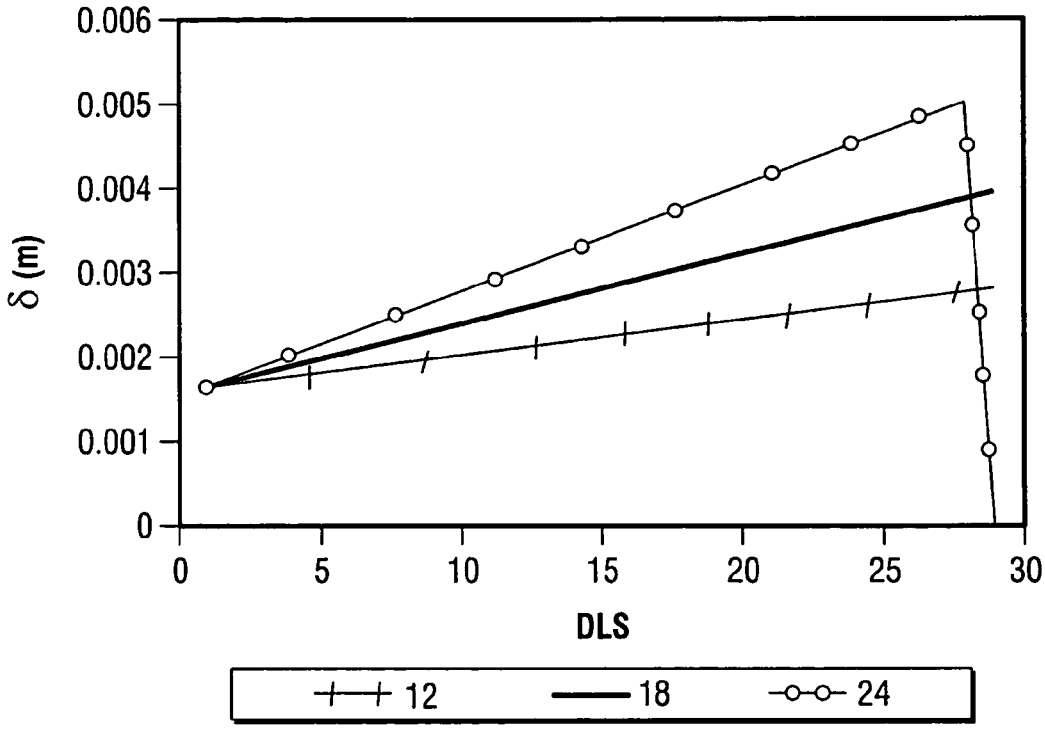

FIGS. 6, 7 and 8 are graphs illustrating the relationship between the displacement δ of the component 22 relative to the axis 18 and the resulting dogleg severities (DLS), for the arrangement illustrated in FIG. 3 and Table 1, FIG. 6 illustrating the case where the near bit stabiliser is of a range of different diameters, FIG. 7 illustrating the case where the component 22 is of a range of different diameters, and FIG. 8 illustrating the case where the near bit stabiliser 20 is located at a range of different distances from the bit 14. In FIG. 6, the discontinuity in the line where the near bit stabiliser is of diameter 8.125 inches occurs because part of the profile of the bit 14 then starts to fall outside of part of the profile of the component 22.

Other than as described herein, the arrangement illustrated in FIG. 3 has the dimensions and operating parameters set out in Table 1.

TABLE 1

| Position Relative to Drill Bit 14 | |
|---|---|
| Component 22 | 6 in |
| Near bit stabiliser 20 | 12 in |
| Upper Stabiliser 21 | 20 ft |
| Diameters | |
| Drill bit 14 | 8 in |
| Component 22 | 8.5 in |
| Near bit stabiliser 20 | 8.375 in |
| Upper stabiliser 21 | 8.375 in |
| WOB | 4 T |
| Rotary Speed | 180 rpm |

FIGS. 6, 7 and 8 illustrate that for small displacements of the component 22 relative to the axis 18, significant levels of steering can be achieved. These figures further demonstrate that the system is very sensitive to wear of the near bit stabiliser 20 and component 22. However, even with relatively large levels of wear, where the system is capable of displacing the component 22 through a distance of approximately 5 mm, the system will still be able to achieve aggressive steering. Further, the system is less sensitive to wear with the near bit stabiliser 20 at increased distances from the bit 14.

It is anticipated that the component 22 will experience a similar level of wear to the drill bit 14. Although the component 22 will experience increased wear due to the side forces exerted in steering the system, it is more constrained, mechanically, and so should suffer less vibrational impacts. The layout of individual cutters upon the component 22 may be such as to provide some degree of redundancy to permit continued use even in the event of the failure of one or more of the cutters thereof. The near bit stabiliser 20 is of importance to the efficient operation of the system and in the event of catastrophic wear, the side forces on the component 22 would be reacted by the opposite side of the bit 14 rather than by the stabiliser 20. In such circumstances, if the component 22 is designed to be more aggressive as a side cutter than the bit 14, the system will continue to operate, although much less effectively than where the near bit stabiliser 20 is not worn.

Figure 9:
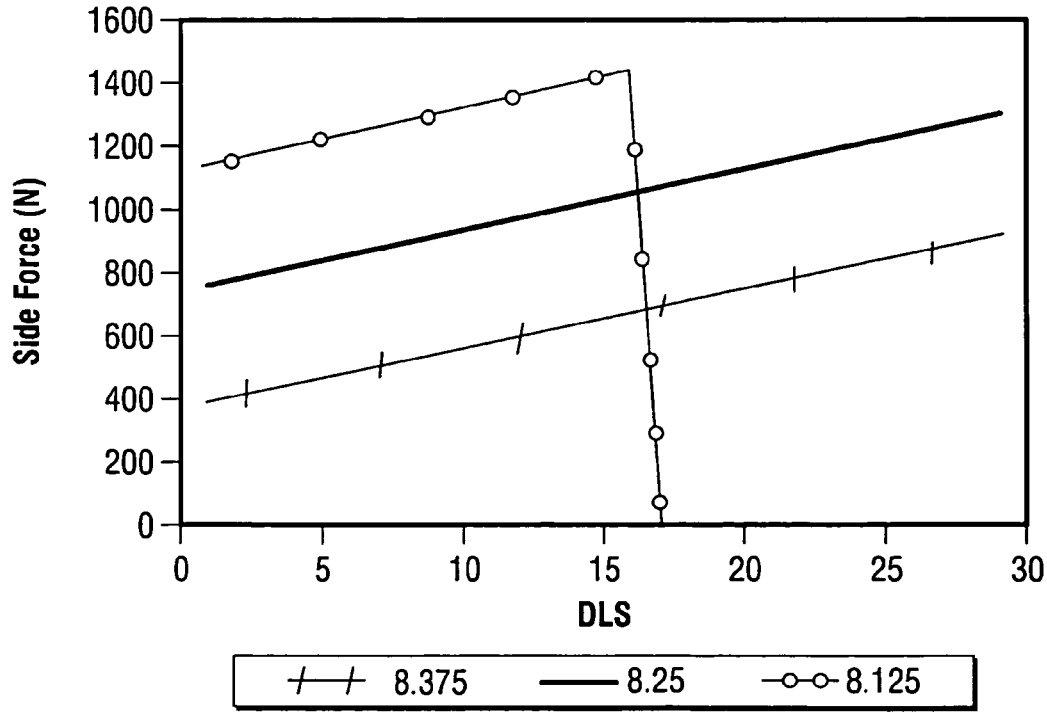

FIG. 9 illustrates the relationship between magnitude of the sideways acting force applied to the component 22 and the dogleg severity of a range of diameters. It shows that, for a system of the type shown in FIG. 3 and having the parameters set out in Table 1, the side forces are relatively low, the largest being approximately 300 lb.

Figure 10:
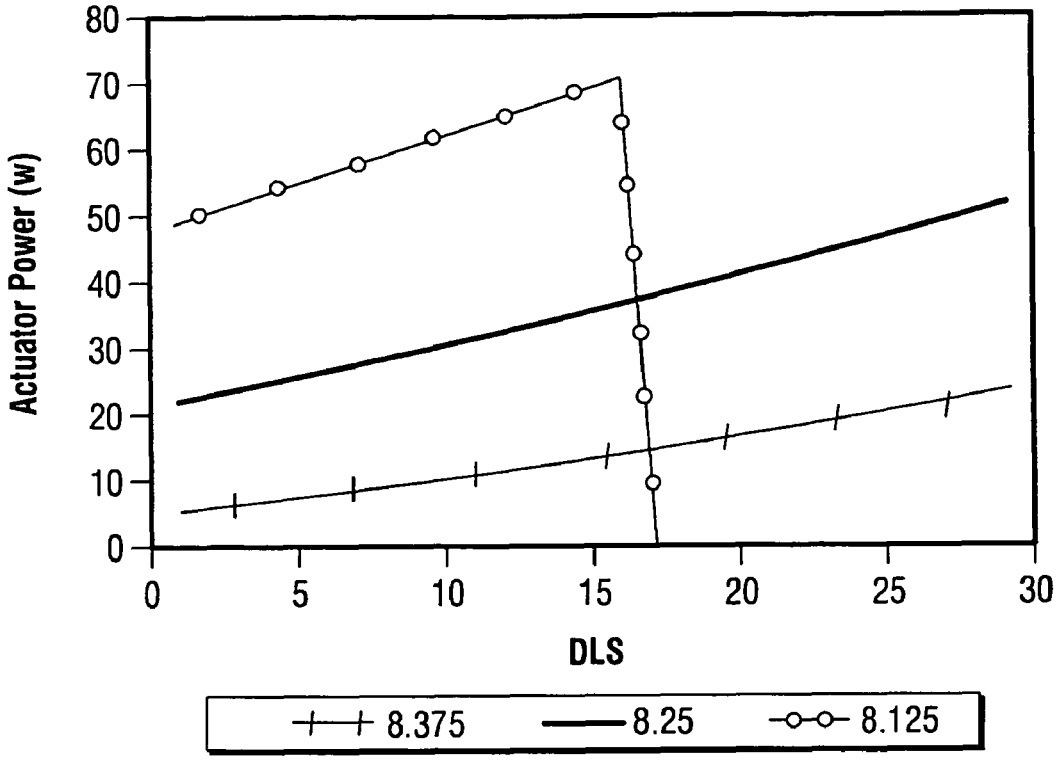

If three pistons or other linear actuators are equally spaced around the housing 16, the mechanical power required to drive the component 22 is as illustrated in FIG. 10, and it will be appreciated that these magnitudes are small.

As with FIG. 6, the discontinuities in FIGS. 9 and 10 result from the bit profile falling outside of profile of the component 22.

Figure 11:
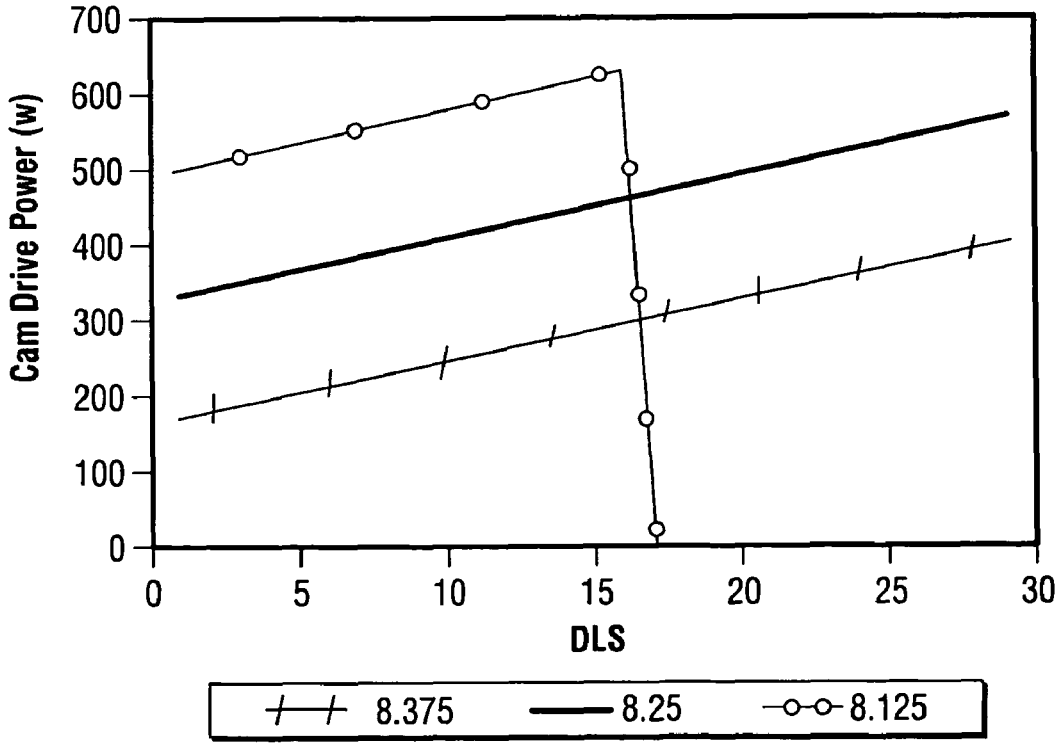

FIG. 11 illustrates the magnitude of the rotary power required to move a rotatable cam arrangement, for example as shown in FIG. 5, to achieve the forces required in FIG. 9. FIG. 11 shows that a 1 kW motor should be adequate to operate the system.

The invention described hereinbefore enables aggressive steering to be achieved using a system of relatively short axial length and with low power requirements compared to a typical arrangement.

It will be appreciated that a wide range of modifications and alterations may be made to the arrangement described hereinbefore without departing from the scope of the invention.

The invention claimed is:

1. A steerable drilling system comprising a rotary drill bit secured to a housing, a secondary rotary drill component carried by the housing and rotatable therewith, the second rotary drill component having a gauge dimension greater than that of the rotary drill bit, and a drive arrangement operable to displace the secondary rotary drill component relative to the housing whilst maintaining an axis of the secondary rotary drill component substantially parallel to an axis of the housing, wherein the secondary rotary drill component is of generally annular form.

2. A system according to claim 1, further comprising a near bit stabiliser.

3. A system according to claim 1, wherein the secondary rotary drill component is located between a near bit stabiliser and the rotary drill bit.

4. A system according to claim 1, wherein the drive arrangement comprises a plurality of linear actuators.

5. A system according to claim 4, wherein the linear actuators are in the form of pistons.

6. A system according to claim 4, wherein the linear actuators are arranged generally radially.

7. A system according to claim 1 wherein the drive arrangement comprises an eccentric cam arrangement.

8. A system according to claim 7, wherein the eccentric cam arrangement comprises inner and outer cam components, adjustment of the relative positions of which displaces the secondary drill component relative to the housing.

9. A system according to claim 1, wherein the rotary drill bit comprises one of a fixed cutter drill bit, a roller-cone drill bit and a tri-cone drill bit.

10. A system according to claim 1, wherein the secondary rotary drill component includes cutting elements of the fixed or roller-cone type.

11. A method of forming a borehole comprising rotating a rotary drill bit about its axis to form a borehole, rotating a secondary rotary drill component of generally annular form and having a gauge dimension greater than the gauge dimension of the rotary drill bit about its axis, and displacing the axis of the secondary rotary drill component substantially parallel to the axis of the rotary drill bit to form a displaced region in the borehole.

12. A method according to claim 11, wherein the rotary drill bit and secondary rotary drill component form parts of a steerable drilling system as claimed in any of claims 1-3, 4-5, 6, or 7-10.

13. A method according to claim 11, further comprising a step of providing a near bit stabiliser, and moving the near bit stabiliser into the displaced region of the borehole to apply a side load to the rotary drill bit.

* * * * *